US005788784A

United States Patent [19]

Koppenhoefer et al.

[11] Patent Number: 5,788,784

[45] Date of Patent: Aug. 4, 1998

[54] PROCESS FOR INTERMEDIATELY QUENCHING LIGHT-METAL CASTINGS COMING FROM A SOLUTION HEAT TREATMENT FURNANCE

[75] Inventors: Ralph Koppenhoefer, Mainhardt; Siegfried Weimer, Leonberg, both of Germany

[73] Assignee: Mercedes-Benz AG, Stuttgart, Germany

[21] Appl. No.: 675,005

[22] Filed: Jul. 3, 1996

[30] Foreign Application Priority Data

Jul. 3, 1995 [DE] Germany ..... 195 24 176.2

[51] Int. Cl.[6] ..... C22C 1/00

[52] U.S. Cl. ..... 148/549; 148/709; 148/713; 148/538; 148/549; 148/551; 266/114; 266/113

[58] Field of Search ..... 266/114, 113; 148/709, 713, 538, 549, 551

[56] References Cited

U.S. PATENT DOCUMENTS

| | | | |
|---|---|---|---|
| 3,997,376 | 12/1976 | Hemsath et al. | 266/114 |
| 4,373,706 | 2/1983 | Elhaus et al. | 266/252 |
| 5,112,412 | 5/1992 | Plata et al. | 148/549 |
| 5,294,094 | 3/1994 | Crafton et al. | 266/44 |
| 5,340,418 | 8/1994 | Wei | 148/549 |
| 5,350,160 | 9/1994 | Crafton et al. | 266/252 |
| 5,354,038 | 10/1994 | Crafton | 266/44 |

FOREIGN PATENT DOCUMENTS

| | | | |
|---|---|---|---|
| 0 051 549 | 5/1982 | European Pat. Off. | C22F 1/04 |
| 546 210 | 6/1993 | European Pat. Off. | B22D 29/00 |
| 2223463 | 10/1974 | France | C21D 1/62 |
| 2634866 | 2/1990 | France | 148/709 |
| 1 558 798 | 3/1977 | German Dem. Rep. | C22F 1/00 |
| 60-170567 | 9/1985 | Japan | B22D 29/00 |

OTHER PUBLICATIONS

Metadex 93(9) :56–1292, F. Moreaux et al., "Some Developments About Spray Quenching", Materials Austrrralia, Mar. 1992, 24, (2) (Abstract).

Patent Abstract of Japan JP 01–287256, dated Nov. 17, 1989.

Foreign Search Report dated Oct. 18, 1996.

Crafton, Jr., Paul M., "Heat Treating, Aging System also Permits Core Sand Removal", Modern Casting, Sep. 1989, pp. 48–50.

*Primary Examiner*—David A. Simmons
*Assistant Examiner*—M. Alexandra Elve
*Attorney, Agent, or Firm*—Evenson McKeown Edwards & Lenahan PLLC

[57] ABSTRACT

This invention relates to a process for heat treating light-metal castings, particularly cylinder heads for piston engines, in which, after solidifying and removing the castings from the mold, they are solution treated with the residual casting heat at approximately 530° C., are quenched, aged at approximately 170 to 210° C. and are then cooled to room temperature. The castings are quenched individually with a mist-type fine mixture of air and water, which is nozzle sprayed on all sides by forced convection flow only to approximately 130 to 160° C., and are charged at this temperature, while utilizing the residual heat, into an aging furnace. The evaporation heat of the water is utilized as latent cooling heat. The forming water vapor, carried away by the workpieces, is condensed and the condensed water is guided back to moisten the air/water mixture.

18 Claims, 3 Drawing Sheets

PROCESS FOR INTERMEDIATELY QUENCHING LIGHT-METAL CASTINGS COMING FROM A SOLUTION HEAT TREATMENT FURNANCE

BACKGROUND AND SUMMARY OF THE INVENTION

This invention relates to a process for heat treating light-metal castings, wherein, after the light-metal castings are solidified and removed from their mold with the cores intact, the light-metal castings are heated with the residual casting heat in a furnace for a solution treatment for a certain time at approximately 530° C., and subsequently quenched and then aged in an aging furnace for a certain time at approximately 170° to 210° C., and finally cooled to room temperature, as customary in industrial practice.

In this regard, reference can be made, for example, to European Patent Document, EP 546,210, which describes a combined process for the pyrolytic destruction of cores, for regeneration of; the sand core and for heat treatment of the castings in a joint uniform treatment step in a furnace with subsequent quenching of the castings in a water bath.

Today, light-metal castings are normally solution heat treated after the casting operation and are then quenched in a water bath by immersing the casings in a water bath. The quenching bath is maintained at approximately 30° to 70° C., because of the continuous addition of fresh water in order to compensate for evaporation losses. In part because the sand, particularly in the core area, still adheres to the castings, the water does not advance uniformly to all surface areas so that the quenching effect will be quite different at a local level, resulting in a corresponding warping of the castings.

Another problem resulting from the non-uniformity of the quenching effect is caused by the different local flow-around conditions. In areas where good flow takes place, the vapor layer, formed between the workpiece surface and the bath water, is continuously renewed by newly entering water. However, in areas where the water is basically stagnant, a more or less stable vapor lock may form between the workpiece surface and the water bath which prevents efficient dissipation of heat from the workpiece into the bath water.

In order to increase the quenching effect, heating the water is limited. The bath temperature is stabilized at approximately 30° to 70° C., usually by adding fresh water. In addition, because of a sufficiently long residence time in the quenching bath, the castings are quenched to approximately the bath temperature, thus to approximately 30° to 70° C., in order to ensure that sufficient quenching takes place even in less favorable areas. Thus, after quenching, the castings must be heated again to the aging temperature in an energy-intensive manner for the subsequent aging step.

During quenching of the workpieces in the water bath, sand residue remains, for the most part, at least in the cavities of the workpiece. After quenching in the water bath, these deposits of wet sand must first be dried separately, at high-expenditure and in an energy-intensive manner, before the sand can be removed by shaking and/or blowing, and before the castings can be aged in the aging furnace. If, during the quenching of the workpieces in the water bath, sand falls out of the castings, this sand forms mud together with other bath water impurities which cannot be reused because of the impurities and which, because of the wetness, can not be charged in this condition into the sand core regeneration without being dried first. This means that the contaminated mud must be removed at high-cost and the removed sand must be replaced at cost.

It is an object of the present invention to improve the heat treatment process of light-metal castings by obtaining better results from the heat treatment and by lowering the operating costs.

Based on the above-mentioned heat treatment process, this object is achieved according to the present invention by quenching the castings individually with a mixture of air and water to approximately 130° to 160° C., wherein the air/water mixture is sprayed in a mist-type fine manner and distributed by forced convection flow on all sides onto the castings and/or the air/water mixture is nozzle-sprayed in a mist-type fine manner and distributed on all sides onto the castings, and-wherein the castings are charged at quenching temperature while utilizing the residual heat in the aging furnace.

As a result of the quenching with an air/water mixture according to the present invention, a sufficiently rapid quenching of the castings, as well as a uniform cooling and a low-distortion cooling, is achieved. Also, as a result of the easily controlled and uniformly progressing quenching, the quenching temperature can be determined by the quenching time. The quenching does not have to take place at an unnecessarily low temperature. A considerable amount of residual heat may be utilized, thereby saving energy and heating time. In addition, the adhering sand is not wetted and can be collected in a fluid and clean form and can be reused after regeneration, thereby resulting in a reduced sand consumption. Furthermore, the cumbersome and high-cost drying of the castings before the aging treatment is not necessary. Additionally, since the evaporation heat of the water can be used for quenching and the vapor formed can be collected and condensed, little water is consumed.

Japanese Patent Application No. JP 60-170567 discloses a method and an arrangement to cool or quench light-metal castings with an air/water mixture. More specifically, JP 60-170567 shows a process and an arrangement for cooling freshly cast light-metal rims which are still partially in the casting mold, wherein the hub and the wheel disk area is carefully cooled from the casting heat with a mist of water which is fed from a nozzle arranged in a targeted manner.

According to German Patent No. DE 15 58 798, light-metal workpieces are cooled from a temperature above 371° C. at a cooling rate of more than 83° C./s as a result of the fact that the workpieces are nozzle-sprayed with fine water jets at high speed, at a pressure of 10 to 42 bar. The effect of this type of nozzle spraying is to that the water jet dissolves into many very fine droplets which penetrate the vapor boundary layer and achieve a higher cooling rate than in the case of immersion cooling.

However, the use of an air/water mixture in connection with the heat treatment of light-metal castings, particularly in order to improve the heat treatment process by lowering cost and improving function, is new and surprising to a person skilled in the art, because of the multiple advantages described herein.

The advantages of the heat treatment process according to the present invention are as follows:

After solution treatment, the cast workpieces can be quenched more carefully and uniformly in comparison to quenching in a water bath, whereby a good workpiece hardness and a reduction of warping of the casting caused by quenching is achieved.

As a result of the controllability of the quenching, the quenching can take place in a targeted manner to a certain temperature, particularly slightly below the aging temperature whereby a considerable amount of heating energy for the subsequent aging treatment can be saved, thus reducing energy costs and also heating time. The latter also has a favorable effect on the productivity of the system.

Since the castings remain dry during quenching, the sand can be removed in a simpler and more reliable manner, because the sand which adheres to the workpieces remains dry and during the quenching, the sand detaches more reliably and completely from the workpiece. In addition, the dry sand can easily be shaken out and/or blown out of the workpieces.

A separate and energy-intensive drying of the castings is as unnecessary as well as a separate, well-ventilated drying furnace, because of the fact that the castings remain dry during the quenching. This reduces not only the operating costs, but also the investment costs.

As compared to the prior art, lower sand losses and lower removal costs of old sand occur because of the fact that the sand which falls out of or off the workpieces during the quenching, because it remains dry, can easily be returned to the sand core regeneration. As a result, not only is new sand saved, but a corresponding amount of waste and relative disposal costs are also avoided.

The water consumption for the quenching is also very low because the vapor is condensed and the condensate can be reused, which also saves costs.

In summary, therefore, because of the quenching of the light-metal castings according to the present invention, in the overall process of the production of castings, not only is a better product achieved, but considerably less energy, less core sand, less water and less time is consumed and less waste is generated.

Other objects, advantages and novel features of the present invention will become apparent from the following detailed description of the invention when considered in conjunction with the accompanying drawings.

DETAILED DESCRIPTION OF THE PREFERRED EMBODIMENT

Figure 1:
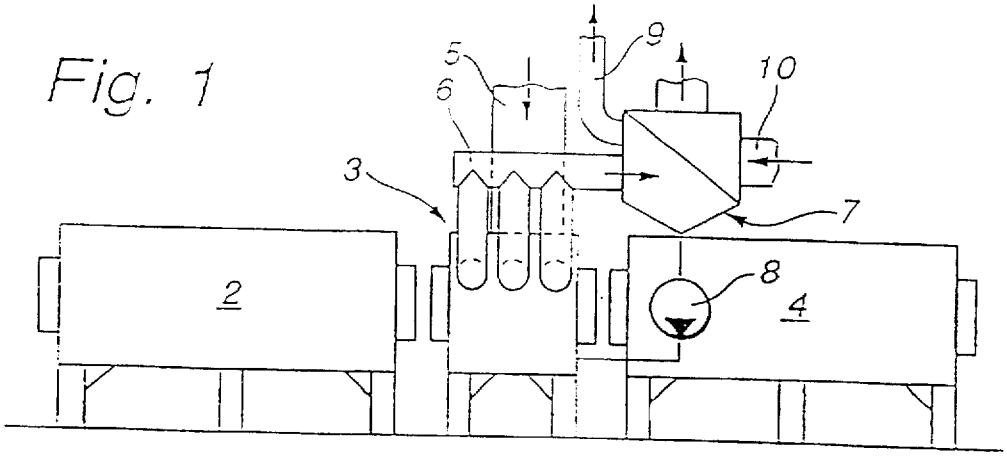
FIG. 1 is a schematic representation of a lateral view of a system for the heat treatment of light-metal castings.

The heat treatment system for light-metal castings, preferably cylinder heads for piston engines, illustrated in FIG. 1 consists of a solution heat treatment furnace 2, an adjoining quenching device 3, as well as an aging furnace 4 which follows in the feed direction. After solidification, removal from the mold and removal of the core, the light-metal castings are charged into the solution heat treatment furnace which may be, for example, a gravity discharge furnace.

In the solution heat treatment furnace 2, the parts are heated to approximately 530° C. and are treated at this temperature for a predetermined time, for example, for four hours. It should be noted that the solution heat treatment furnace may be in the form of a combined treatment furnace as disclosed in EP 546,210, cited above, in which the workpieces can not only be solution treated but in which the sand cores are also pyrolytically destroyed and the core compound is completely dissolved into fluid sand. Therefore, the castings do not have to be cooled and the core does not have to be removed beforehand but the residual casting heat can be used to heat to the treatment temperature, whereby heating time and energy is saved. When such a combined process furnace is used, the castings will come out of the solution heat treatment furnace 2 after treatment with a removed core and largely de-sanded.

Figure 2:
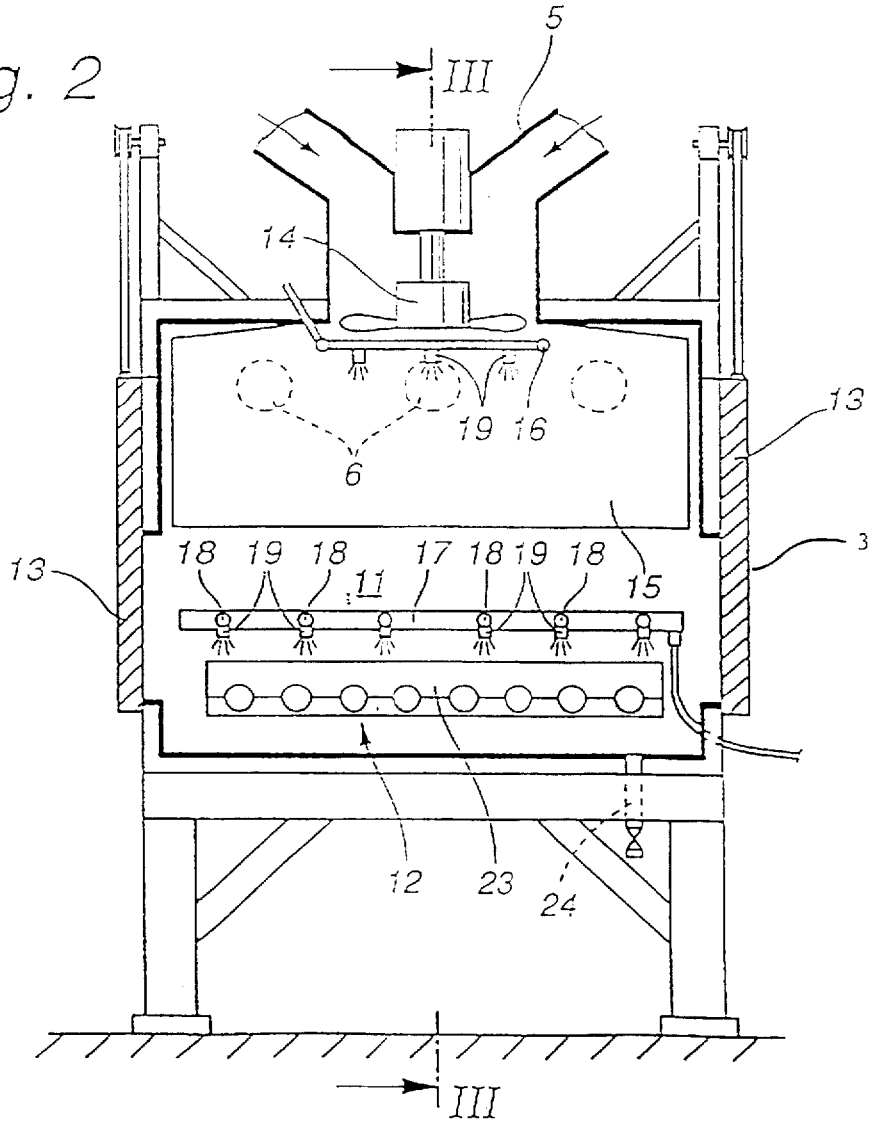
FIG. 2 is an enlarged representation of a vertical sectional view of a quenching device shown in the feed direction view II.
Figure 3:
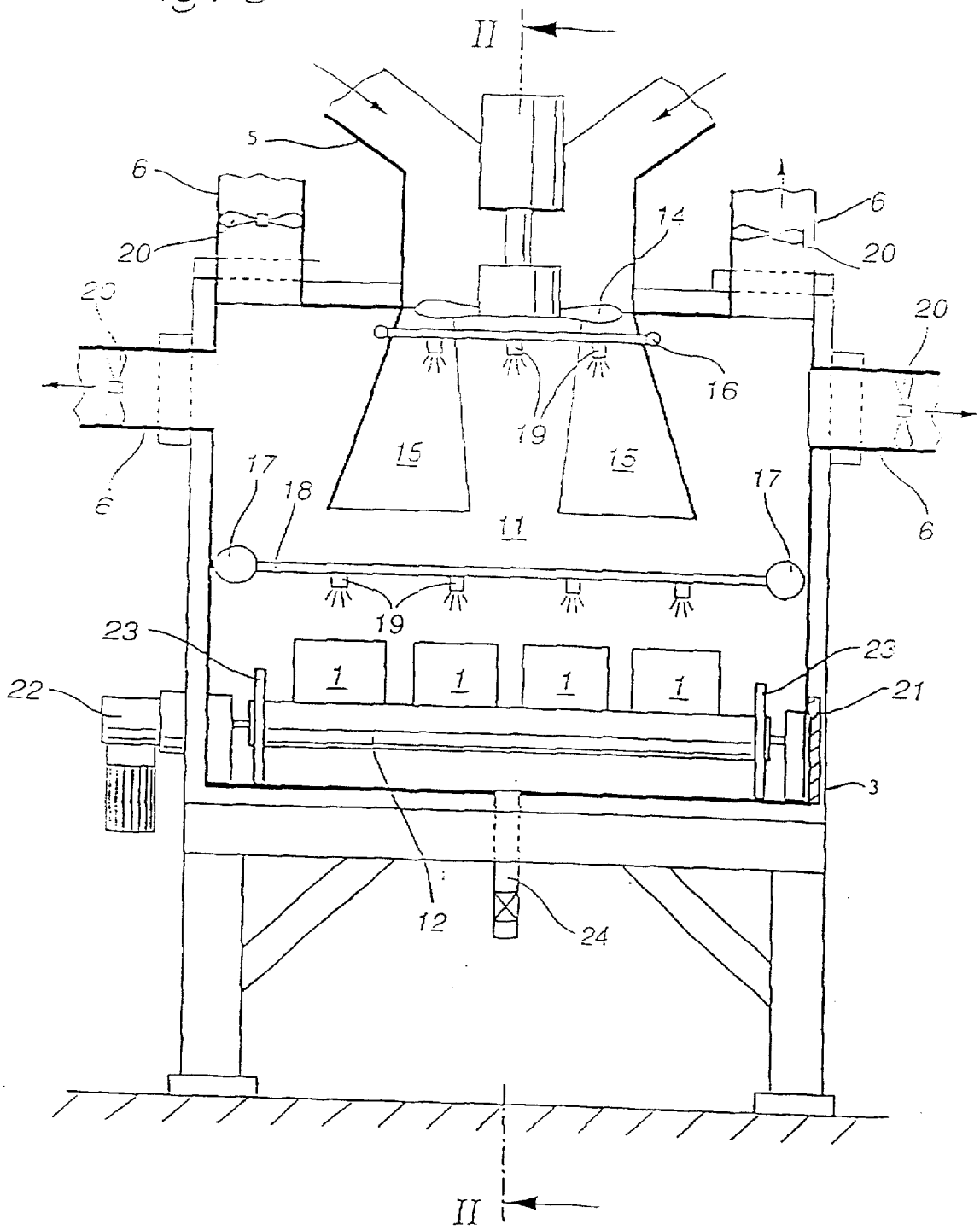
FIG. 3 is an enlarged representation of a vertical sectional view of a quenching device shown transversely to the feed direction view III.

After treatment, the parts must be quenched in a quenching device 3, as shown in more detail in FIGS. 2 and 3. In order to quench the castings according to the present invention, the castings are individually sprayed with a mist-type fine mixture of air and water resulting in a careful quenching which, according to the duration, can be lowered to a particular temperature. It is therefore possible to quench the castings only to approximately 130° to 160° C. As a result, the residual heat of the castings can be used so that the parts can subsequently be charged into the aging furnace 4 while they are still warm. Here, the parts are aged at approximately 170° to 210° C. for a certain time, for example, for approximately four hours. Subsequently, the castings can be cooled in air at room temperature.

It is important to note that during quenching, the parts remain basically dry and that in particular the sand that falls off the castings is also dry. If the core sand does not remain in the cavities of the castings but trickles out of the castings and collects on the bottom of the furnace, it must be removed from time to time.

The quenching device illustrated in detail in FIGS. 2 and 3 is constructed as follows: A treatment space 11 is enclosed with metal sheets. A roller conveyor 12 leads into the treatment space 11 and carries and conveys the castings 1. The rollers may be driven by a roller drive 22. In order to prevent the castings 1 from laterally moving off the roller conveyor 12, side guide plates 23 are mounted on both sides of the roller conveyor. One lifting door 13 is mounted respectively in the front and in the rear of the treatment space and can be opened and closed in an automatic and computer-controlled manner by means of a lifting drive which is not shown.

In order to clear out sand from time to time which has fallen off the castings 1 between the rollers of the roller conveyor 12 and onto the floor of the treatment space 11, cleaning lids 21 are mounted laterally to the treatment space. In order to remove residues more readily when the sand is cleared away from the floor of the treatment space 11, the floor is provided with a discharge pipe 24, through which collected sand can be eliminated.

On the top side of the treatment space 11 an air supply blower 14 is mounted so that air can be taken in at room temperature and can be blown into the treatment space at a high circulating rate. The air is guided by air-conducting plates 15, mounted in the interior of the treatment space. In a preferred embodiment, an upper level of spraying nozzles 19 is mounted directly behind the air supply blower 14, which are connected to a ring conduit 16 supplied with water. This water is very finely atomized by the nozzles and is transferred to the supplied air. A lower level of spraying nozzles is mounted close above the castings. For this purpose, two longitudinal support pipes 17 and several transverse pipes 18 are provided, wherein the transverse pipes 18 are connected with the longitudinal pipes in a ladder type manner. The transverse pipes 18 carry the spraying nozzles 19, distributed in a surface-covering manner. The spraying nozzles spray the supplied water directly onto the castings 1.

As a result of this configuration of the quenching device, the castings 1 are sprayed individually from all sides in a locally targeted manner with finely sprayed water, which is a mixture of air and water. The water is suspended in the air in the form of mist-type fine droplets. When the droplets land on the two castings, the water evaporates and the evaporation heat is utilized as latent cooling air. As mentioned above, as a consequence of this type of cooling, a careful but nevertheless sufficiently rapid quenching is achieved, wherein the quenching effect is locally uniform and may lower the temperature to a specific temperature of the workpiece, so that residual heat remains and be utilized for the subsequent aging step.

By way of the air supply device 5 and the air supply blower 14, approximately 1,500 to 5,000 $m^3/h$, preferably approximately 4,000 $m^3/h$, of air are conveyed into the treatment space 11, and approximately 0.25 to 1 liters, preferably 0.5 liters, of water per kilogram casting material can be sprayed into the supplied air at approximately 12 to 24 bar. As a result, a cooling temperature of approximately 280° to 320° C. per minute can be achieved. The process is provided particularly effective for the quenching of cylinder heads for piston engines.

The air blown into the treatment space, together with the vapor that is formed must be rapidly moved out from this treatment space again. For this purpose, several vapor draw-off pipes 6 with vapor draw-off blowers 20 are arranged laterally in the roof area of the treatment space. In order to avoid short-circuiting the air flow between the air supply blower 14 and the vapor draw-off blowers 20, two air conducting plates 15 are mounted between the two blowers. In order to be able to at least partially reuse the used water, the forming water vapor carried away by the castings 1 is guided into a condenser 7, and the condensed water is collected and guided back by means of a condensate pump 8 for moistening the air/water mixture. Condensation energy is supplied to the condenser 7 by way of cold air from the cooling air pipe 10. The air heated in the condenser is also blown into the open air. Because of the condensation of the quenching water, approximately 75 to 95%, preferably approximately 90%, of the water can be reused. The remaining water is carried, together with the air, into the open air by way of the air discharge pipe 9.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A process of making light-metal castings, comprising the steps of solidifying and removing the castings, containing a core, from a mold, heating the castings with residual casting heat in a furnace for a solution treatment for a preselected time to approximately 530° C., individually quenching the castings with a mixture of air and water at approximately 130° to 160° C. in a quenching device, wherein the water evaporates to form water vapor which is carried away by forced convection flow with an air flow in the range of from 1,500 to 5,000 $m^3/h$, charging the castings at quenching temperature into an aging furnace, aging the castings in the aging furnace for a preselected time at approximately 170° to 210° C., and cooling the castings to room temperature, wherein the quenching step comprises at least one of spraying the mixture of air and water in a fine mist, which is distributed by forced convection flow onto all sides of the castings and nozzle-spraying the mixture of air and water in a fine mist, distributed onto all sides of the castings.

2. The process according to claim 1, wherein the quenching step comprises quenching the castings with the mixture of air and water by suspending the water in the air in the form of fine mist droplets in a treatment space of the quenching device, which space is closed but well ventilated in a forced convective manner, using the evaporation heat of the water as latent cooling heat so that vapor formed from the water is continuously drawn off, and keeping the castings dry.

3. The process according to claim 1, wherein the quenching step comprises collecting the water vapor in a condensation space, condensing the water vapor collected in the condensation space to form condensation water, and guiding the condensation water back with a condensation pump for moistening the mixture of air and water.

4. The process according to claim 1, wherein the quenching step comprises quenching castings that are cylinder heads for piston engines.

5. The process according to claim 1, wherein the quenching step comprises carrying away the water vapor by forced convection flow with an air flow of approximately 4,000 $m^3/h$.

6. The process according to claim 1, wherein the quenching step comprises quenching the castings in approximately 1 minute from approximately 530° C. to approximately 130° to 160° C.

7. The process according to claim 1, wherein the quenching step comprises quenching the castings in approximately 1 minute from approximately 530° C. to approximately 180° C.

8. The process according to claim 1, wherein the quenching step comprises quenching the castings using approximately 0.25 to 1 liters of water per kilogram of casting material in the form of air-suspended water mist.

9. The process according to claim 1, wherein the quenching step comprises quenching the castings using approximately 0.5 liters of water per kilogram of casting material in the form of air-suspended water mist.

10. The process according to claim 1, wherein the quenching step comprises condensing the water vapor to form condensed water, and nozzle-spraying the condensed water again, wherein approximately 75 to 95% of the water is reused.

11. The process according to claim 1, wherein the quenching step comprises condensing the water vapor to form condensed water, the nozzle-spraying the condensed water again, wherein approximately 90% of the water is reused.

12. The process according to claim 1, wherein the quenching step comprises cooling the castings by approximately 280° to 320° C. per minute.

13. A process for quenching light-metal casting, comprising the step of individually quenching the casting with a mixture of air and water in a quenching device, wherein the water forms water vapor which is carried away by forced convection flow with an air flow in the range of form 1,500 to 5,000 $m^3/h$, and wherein the quenching step comprises at least one of spraying the mixture of air and water in a fine mist and distributing by forced convection flow on all sides onto the casting and nozzle-spraying the mixture of air and water in a fine mist distributed on all sides onto the castings.

14. The process according to claim 13, wherein the quenching step comprises quenching the castings at approximately 130° to 160° C.

15. The process according to claim 13, wherein the quenching step comprises quenching the castings with the mixture of air and water by suspending the water in the air in the form of fine mist droplets in a treatment space of the quenching device, using the evaporation heat of the water as latent cooling heat so that vapor formed from the water is continuously drawn off and keeping the castings dry.

16. The process according to claim 13, wherein the quenching step comprises cooling the casting by approximately 280° to 320° C. per minute.

17. The process according to claim 13, wherein the quenching step comprises quenching the castings using approximately 0.25 to 1 liters of water per kilogram of casting material in the form of air-suspended water mist.

18. The process according to claim 13, wherein the quenching step comprises condensing the water vapor to form condensed water, and nozzle-spraying the condensed water again, wherein approximately 75 to 95% of the water is reused.

* * * * *